United States Patent [19]

Mader

[11] 4,369,726

[45] Jan. 25, 1983

[54] SAILBOAT MAST

[76] Inventor: Paul Mader, Klausenerplatz 20, 1000 Berlin 19, Fed. Rep. of Germany

[21] Appl. No.: 212,719

[22] PCT Filed: Feb. 26, 1980

[86] PCT No.: PCT/DE80/00020

§ 371 Date: Nov. 1, 1980

§ 102(e) Date: Oct. 27, 1980

[87] PCT Pub. No.: WO80/01787

PCT Pub. Date: Sep. 4, 1980

[30] Foreign Application Priority Data

Mar. 1, 1979 [DE] Fed. Rep. of Germany ..... 2907908

[51] Int. Cl.[3] ..... B63B 15/00; B63H 9/10

[52] U.S. Cl. ..... 114/90; 114/103; 114/39; 114/108; 114/94

[58] Field of Search ..... 114/106, 107, 39, 90, 114/102, 108, 89, 91–94, 97, 98, 103–107, 113

[56] References Cited

U.S. PATENT DOCUMENTS

| | | | |
|---|---|---|---|
| 133,072 | 11/1872 | West | 114/106 |
| 2,561,253 | 7/1951 | Coates | 114/102 |
| 3,835,804 | 9/1974 | Jackson | 114/107 |
| 3,882,810 | 5/1975 | Roeser | 114/90 |
| 4,112,865 | 9/1978 | Carn | 114/39 |
| 4,143,611 | 3/1979 | Hayhurst | 114/108 |
| 4,267,790 | 5/1981 | Hood | 114/106 |

FOREIGN PATENT DOCUMENTS

| | | | |
|---|---|---|---|
| 1409740 | 7/1965 | France | 114/90 |

*Primary Examiner*—Trygve M. Blix
*Assistant Examiner*—D. W. Keen
*Attorney, Agent, or Firm*—Frishauf, Holtz, Goodman & Woodward

[57] ABSTRACT

A sailboat mast is composed of two portions, a forward portion supported on the hull by standing rigging and having a concave aft side, and an aft portion, which may be of circular cross-section, supported close to and in line with the forward portion at both ends, the top support, however permitting the top of the aft portion of the mast to be bent away from the forward portion in order to affect the shape of the sail. The main sail is carried by the aft portion of the mast in such a way that when working in any kind of a crosswind, it extends away from the mast in a substantially tangential direction, on the lee side.

6 Claims, 9 Drawing Figures

SAILBOAT MAST

The invention concerns a sailboat mast of the essentially parallel two-piece type, one piece being fixed and held by standing rigging and the other being movable relative to the fixed piece.

Since the air stream along the leeward side of the sail stalls directly behind a conventional mast, a disturbance results at that point, increasing the drag. It is known to counteract this drag by selecting a suitable cross section for the mast or by other measures. Such other measures include making the mast rotatable, enabling the luff of the sail connected to the mast to be turned into the direction of the apparent wind (cf. Juan Baader, (Sailing Technique), published by Delius Klasing, 1973, pp. 68-71). It is also known to design the sail in such a way that it forms a pocket near the mast, thus forming sheet areas tangential to the cross section of the mast, at which the air stream does not stall. However these known measures reduce the possibility of rigging the mast to the hull by means of shrouds, because the pocket or the rotatability of the mast make it impossible to attach a spreader for the shrouds.

The invention has therefore the objective of designing the mast of a sailboat in such a way that it interferes as little as possible with the wind stream at the leeward side of the sail while allowing it to be rigged to the hull by means of shrouds and stays.

A further object of the invention is to enable the portion of the mast carrying the luff of the mainsail to bend aft at the top when that is desired to make the sail more suitable for particular sailing conditions.

Briefly, at or near the mast top, means are provided for guiding and guidably supporting at least the upper portion of the aft part of the mast, which carries the sail, and connecting that mast part to the upper portion of the forward mast part in such a way as to permit the aft mast part to be bent away from the forward mast part.

In one embodiment, the aft mast part is enveloped by a pocket or a sleeve formed from the sail, in which case the sail can lead off from the lee side of the mast to reduce drag from air turbulence without requiring the aft mast part to be rotatable. In that embodiment, the aft mast part may be of ovoid cross-section.

In another embodiment, the aft mast part is equipped with a slot or a track for attachment of the luff of the sail and is mounted rotatably about its longitudinal axis. In this embodiment, the aft mast part is preferably of circular cross-section.

The forward surface of the forward mast part is preferably of eliptical profile, with the major axis of the elipse lying in the longitudinal vertical mid-plane of the hull. Its aft surface is preferably concave to accommodate the aft mast part.

The means of guiding and connecting the aft mast part to the forward mast part at or near the top preferably takes the form of a cap fitting firmly on the top of the forward mast part with an aft extension containing a slot running astern from the mast center, so that the top of the aft mast part, shaped to provide a pin fitting into the slot, will be guided fore-and-aft therein. Lines and sheaves can conveniently be provided therein for trimming the top of the aft mast portion forward and astern for shaping the sail to meet wind conditions.

The invention is now described in greater detail by means of embodiments which are shown in the drawings, in which.

Figure 1:
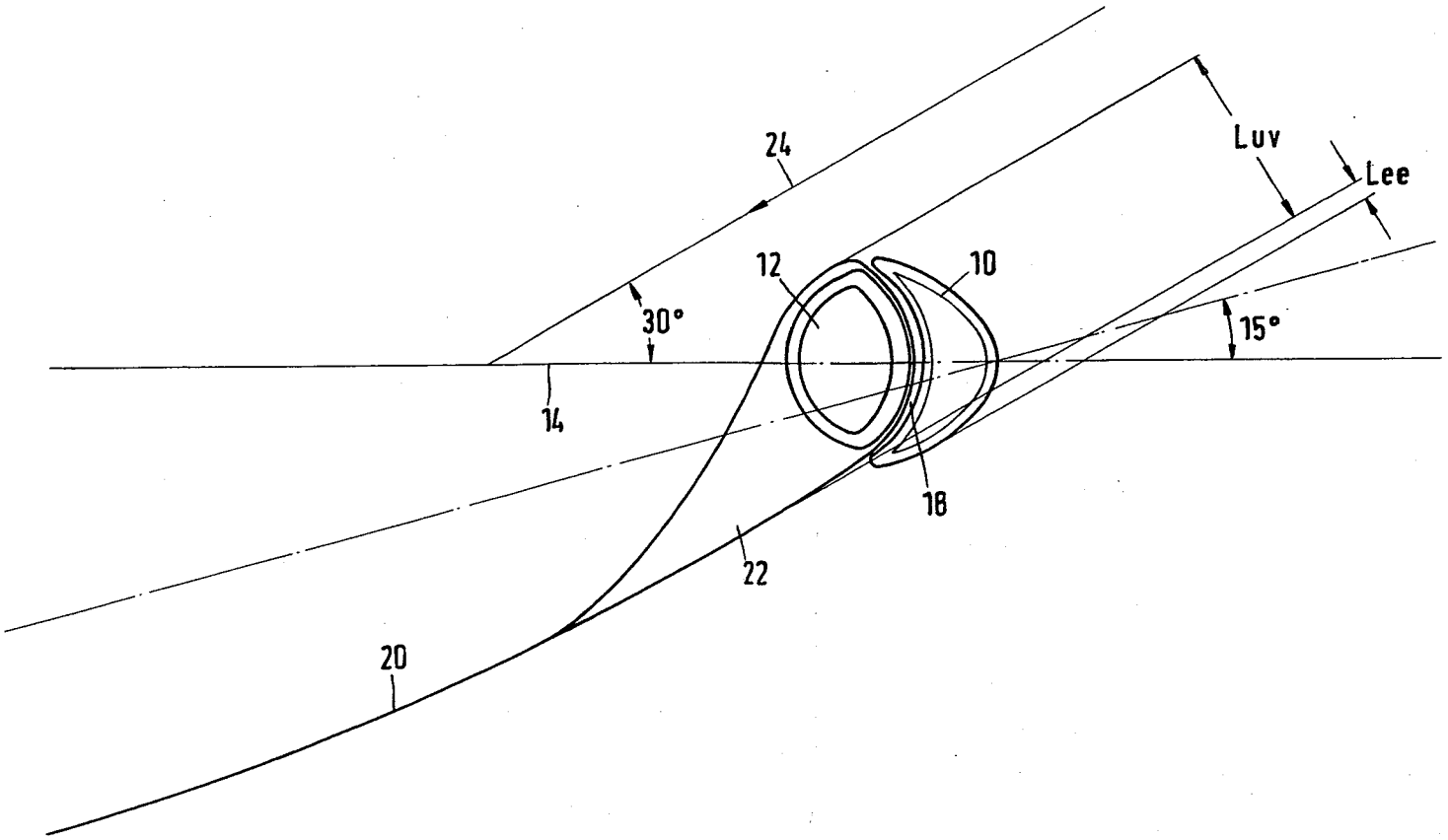
FIG. 1 shows a horizontal cross-section through the mast designed according to the invention and the sail forming a pocket, extending tangentially to the cross-section of the mast on the leeward side where it prevents the air stream from stalling behind the mast.
Figure 4:
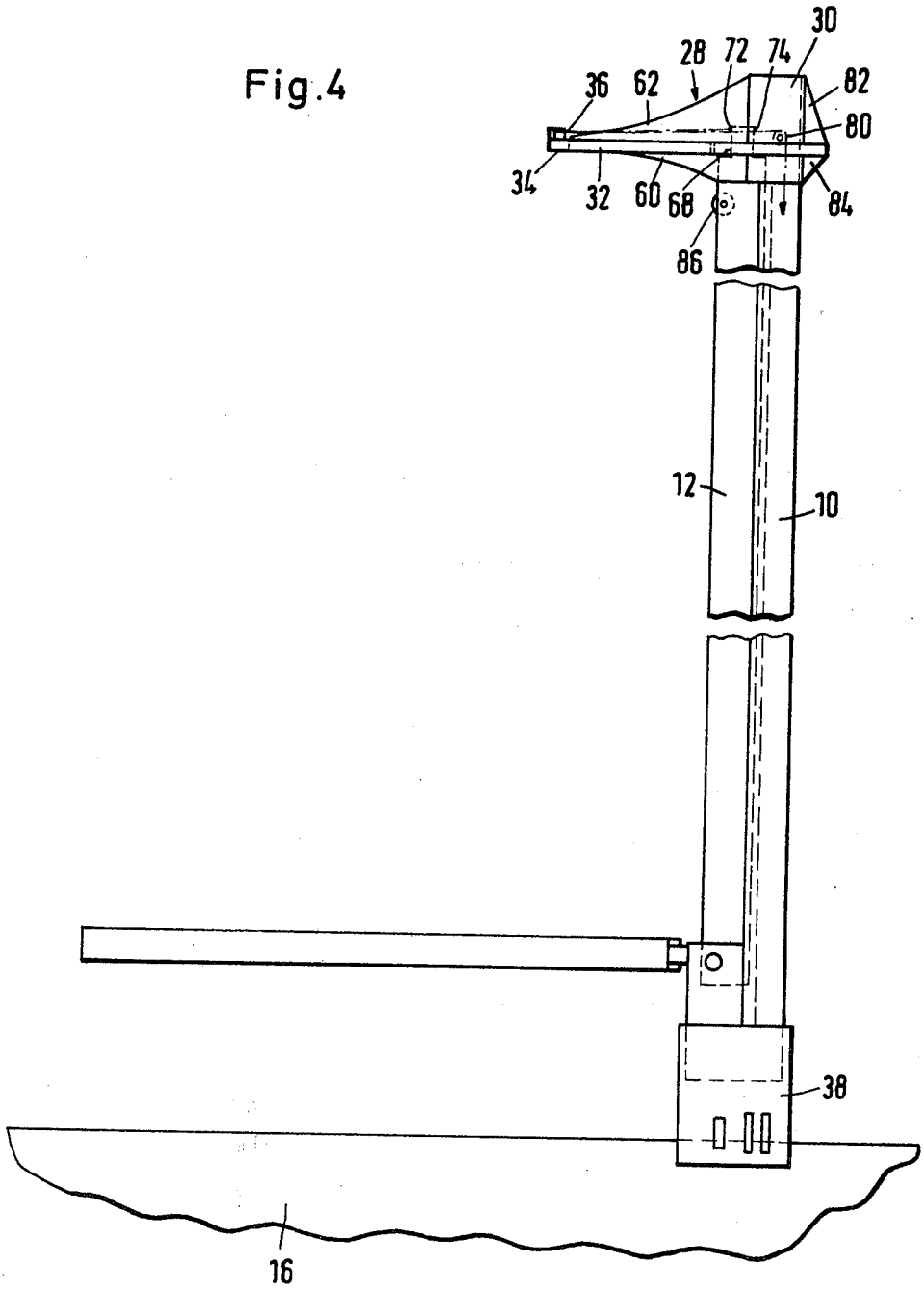
FIG. 4 shows an elevation of rigging for the mast according to FIG. 1 with the main boom.

As shown in FIGS. 1 and 4, the mast consists of a forward mast portion 10 and an aft mast portion 12, both extending from the hull 16 to the top of the mast whose longitudinal axes lie in a vertical median plane 14 of the hull. The forward mast portion 10 has a concave rearwardly-facing channel 18 which is designed symmetrical to longitudinal plane 14. Aft mast portion 12 carries a sail 20, and its upper end is supported on the forward mast portion 10. Whereas the forward mast portion 10 is rigged to hull 16 by means of stays and shrouds the aft mast portion 12 forms only a rod guiding the sail. The forward mast portion may be rigidly attached to a spreader across whose ends the shrouds may be run.

In the embodiment of the invention shown in FIG. 1 the sail 20 forms a pocket 22 surrounding the aft mast portion 12. This has the effect that on the leeward side the sail extends tangentially toward mast portion 12, so that the air stream stalls only in a very narrow region behind the leeward edge of the forward mast portion 10. If the apparent direction 24 of the wind changes, pocket 22 can slide around the aft mast portion 12 into the position in which the sail extends parallel to the direction 24 close to the mast.

To allow the sail to be reefed it is provided with vertical zipper fastenings each of which meets a horizontal slot in the sail pocket. This slot extends to the lateral edge of the other side in front, around the aft mast portion. When the zipper is opened to the length desired for reefing, the sail can be pulled out of the gap between the fore and aft mast portions.

Figure 2:
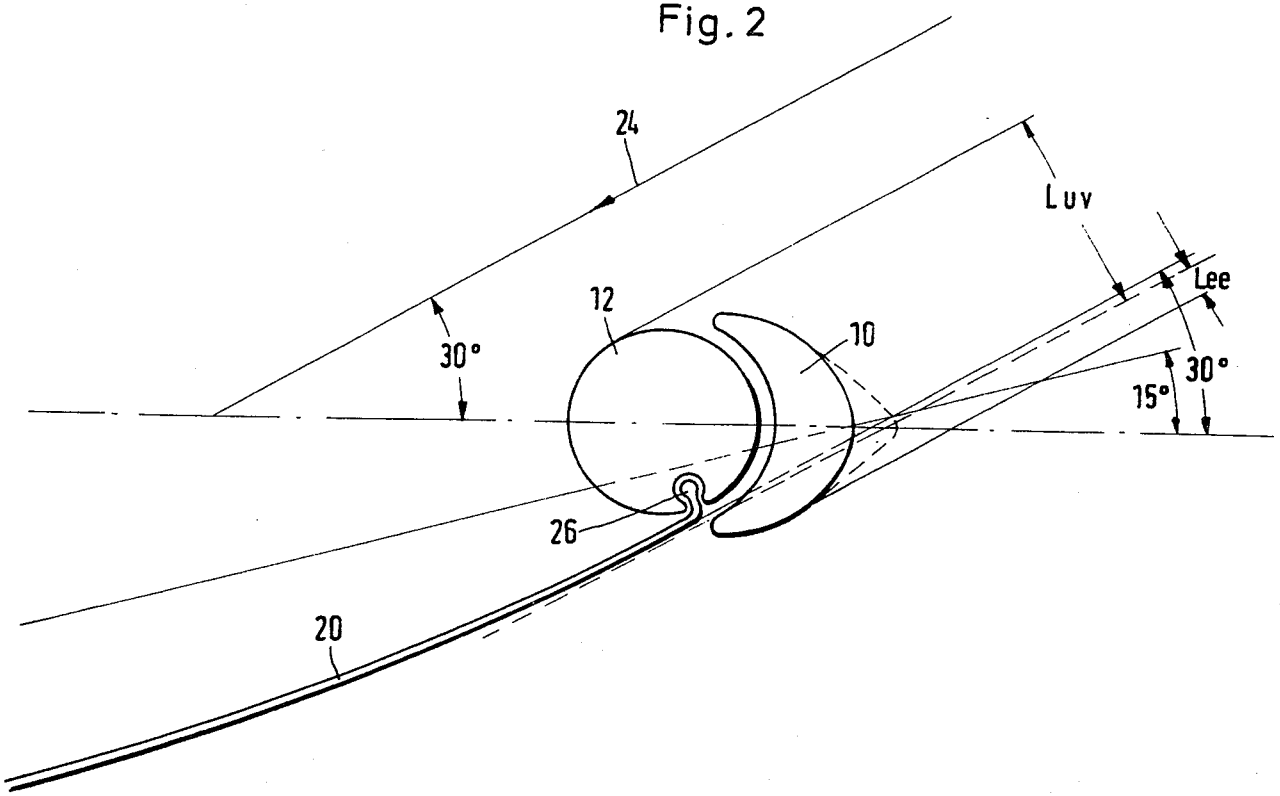
FIG. 2 shows a horizontal cross-section through a differently designed mast to which the main sail is attached by its luff in conventional manner, and wherein the luff can be moved either to the port or startboard sides of the mast.

In the embodiment of the invention in FIG. 2, sail 20 is attached by means of luff rope 26 to aft mast portion 12 and the latter is rotatably adjustable about its longitudinal axis. In this the aft mast portion 12 can have a customary longitudinal notch along which luff rope 26 can be pushed upward from the lower end of the mast. The rotational adjustability of aft mast portion 12 makes possible positioning the notch for luff 26 after each tack toward the leeward side so that sail 20 extends approximately tangentially toward the mast at this side. Because of this rotational freedom, in this embodiment aft mast portion 12 has a circular cross section while in the embodiment according to FIG. 1 it profile is approximately oval.

Figure 3:
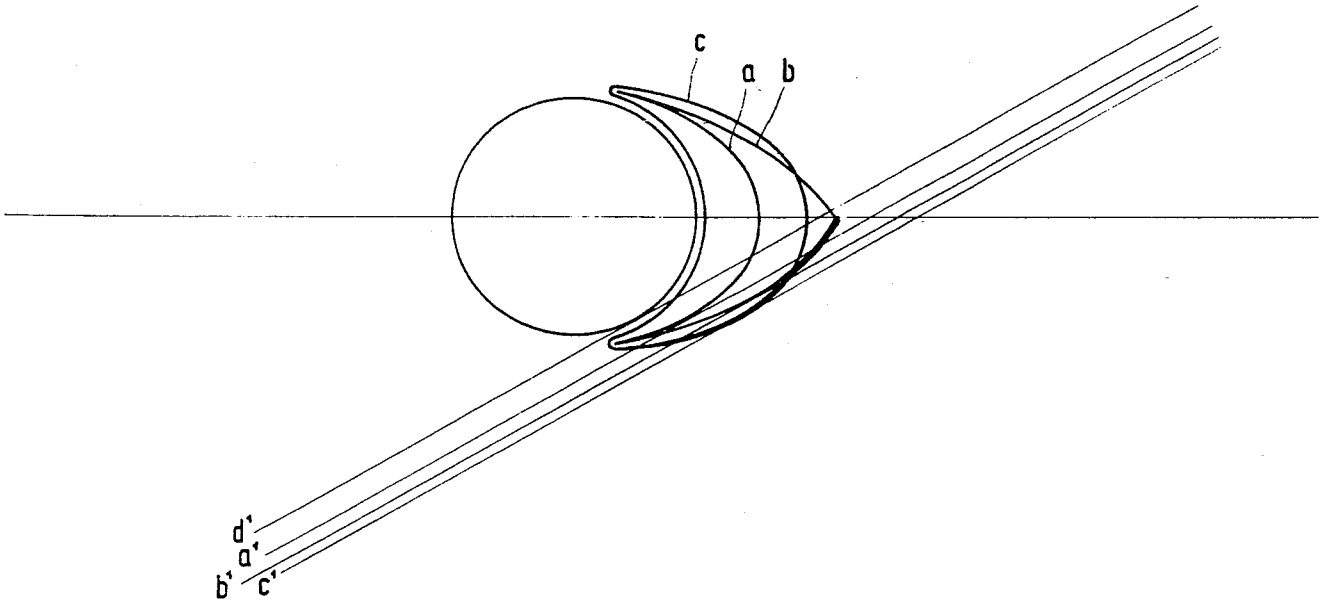
FIG. 3 shows a horizontal section through the mast to illustrate the different widths of the zones of disturbance which result from different profile designs of the mast at the same angle of attack.

The forward area of forward mast portion 10 has an elliptical profile in which the longitudinal axis of the ellipse lies in a plane 14. The tangential planes of the forward area which touch the ends of the elliptical profile section a shown in FIG. 3, enclose between them an angle which should be between 50° to 70°, and preferably 60°. The results in a very narrow zone of disturbance in which, on the leeward side of the sail behind the mast, disturbing eddies can occur. In FIG. 3 this zone is designated as a'.

Also shown in FIG. 3 are other mast profiles designated b and c. Profile c forms approximately a semi-circle, while profile b forms approximately a triangle. Disturbance zones c' and b' are considerably wider than zone a'. This width increases as the angle of attack of the sail in the direction 24 increases. For this reason, in the embodiments of FIGS. 1 and 2 the distance between the ends of elliptical curve a and the aft mast portion 12 is kept as short as possible.

Groove 26 can be substituted by a track attached to the aft mast portion 12, in which slide fittings attached to sail 20 are guidably slidable.

The embodiment shown in FIG. 2 offers the advantage in comparison with that in FIG. 4 that standardized sails in accordance with IOR Specifications can be used.

To turn the aft mast portion 12 about its axis, a worm gear mechanism shown in FIG. 8 can be used which will be described in detail below.

Figure 5:
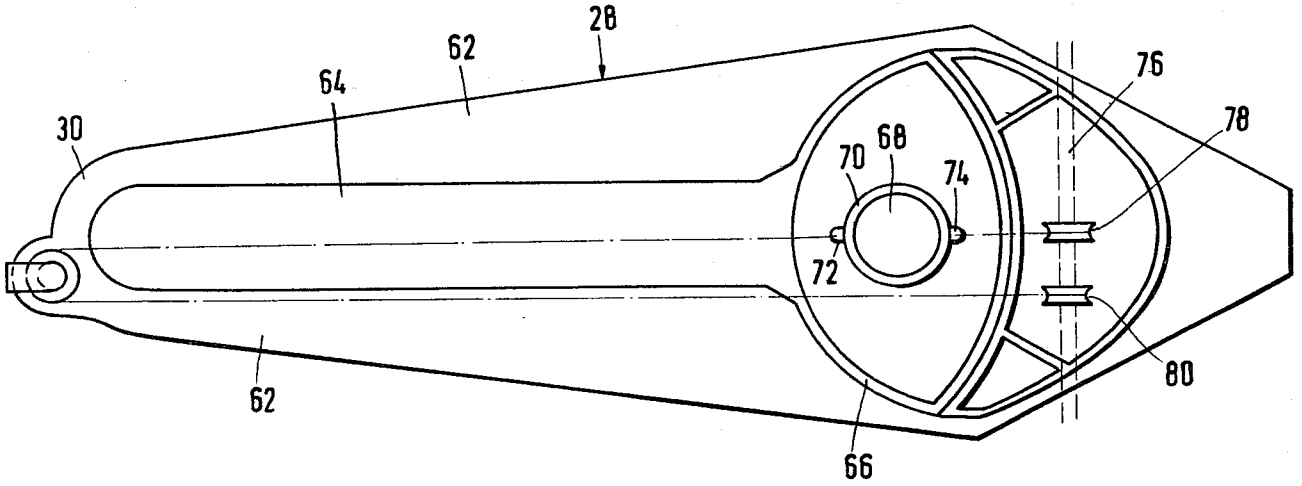
FIG. 5 shows a top view of the head fitting attached to the upper end of the mast shown in elevation in FIG. 4.

At the upper end of forward mast portion 10, a head fitting 28 is attached to mast portion 10 in the embodiment according to FIGS. 1 and 4, shown in FIG. 5 in enlarged scale in plan. This head fitting consists of a formed body of aluminum or of carbon-reinforced plastic. It forms a tubular member 30, whose inner surface has a cross-sectional profile that corresponds to the forward mast portion 10 and is designed in such a way that this tubular member 30 can be pushed over the upper end of forward mast portion 10. The formed piece also forms a horizontal guidance plate 32 which surrounds tubular member 30 and which extends somewhat forwardly but also and to a greater extent toward the stern, and which carries on its aft end 34 a vertical pivot pin for a sheave 36. This guidance plate 32 has on its lower and its upper sides reinforcing ribs 60 and 62 and between these a longitudinal slot 64 which widens into hole 66 adjacent to tubular member 30. The shape of this hole corresponds to the cross-sectional profile of aft mast portion 12 so that the latter can be pushed into hole 66 from below. At its upper end this aft mast portion 12 has a pin 68 whose diameter is somewhat smaller than the width of slot 64. Pin 68 carries ring 70 which has eyes 72, 74 fore and aft. Attached to tubular member 30 above the forward mast portion 10 is horizontal axle 76 which runs horizontally and at right angles to slot 64, and which journals two sheaves 78 and 80.

The forward mast portion 10 is hollow on the inside. A halyard is fastened by one of its ends to eye 72; the halyard runs in sheaves 36 and 80 and extends downward inside the forward mast portion 10. If this halyard is hauled tight, it pulls upper end of aft mast portion 12 toward the stern and thus bends this mast portion. As long as the aft mast portion 12 lies within the channel formed by the forward mast portion 10, it is laterally supported by this channel and by ribs 60. However if it leaves this channel and the supporting area of ribs 60 due to bending, the lateral support of the aft mast portion is taken over by head fitting 28 as pin 68 enters slot 64, whose sides then laterally support the pin.

A second halyard whose end is fastened to eye 74 and which runs over a sheave and the downward 78 in forward mast portion 10, serves the purposes of maintaining the tension in the other halyard, thus giving rigid fore and aft support to the upper end of aft mast portion 12.

For reinforcement, the formed piece before tubular member 30 forms additional ribs 82 and 84, connecting the tubular member with plate 32.

At the under side of head fitting 32 the aft mast portion 12 has a sheave 86 for the main halyard. The downward component of force exerted on this sheave by the main halyard prevents aft mast portion 12 from sliding upward and from losing its footing in the block 38 which will be described in detail below. When the aft mast portion 12 bends toward the stern, a gap occurs between the two mast portions 10 and 12; however this gap is limited to the upper portion of the sail, and thus does not significantly interfere with favorable streaming of air along the lower areas of the sail.

Guidance of the upper end of aft mast portion 12 in slot 64 facilitates the flexing of the aft mast portion 12 which is desirable under certain sailing conditions.

In a simple embodiment of the rigging, the head fitting is of considerably simpler design because no provision is made for the possibility of desired bending of aft mast portion 12. In this case the head fitting has only a hole 66 and lacks pin 68. But even in this case, hole 66 makes it possible to lift the aft mast portion when it is installed in block 38 which will be described below, so that its upper end passes through hole 66, while the aft mast portion 12 is lowered into its final position.

The lower ends of the two mast portions 10 and 12 sit in block 38 which is fastened to the hull. Mast portion 10 is rigidly attached to this block, while mast portion 12 is rotatably attached to it. If forward mast portion 10 is rigged to the hull by means of stays or shrouds, lower mast portion 12 is attached in such a way that its upper end is pushed through the hole in head fitting 28 from below while in diagonal position, and then the lower end of mast portion 12—which may if desired be formed by a pivot pin—is pushed into block 38 from above.

Figure 6:
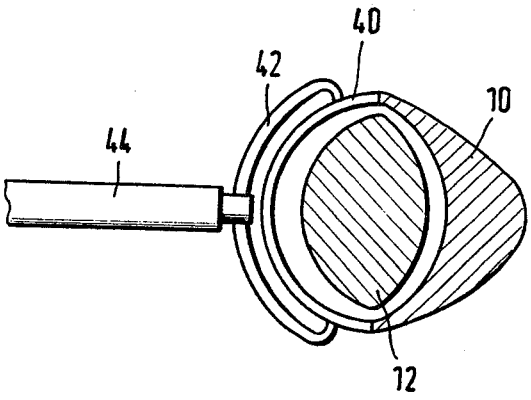
FIG. 6 shows a cross-section through the mast according to the invention illustrating the main boom and its attachment to the mast.

FIG. 6 shows the mast end of the main boom. It is guidably slidable along a horizontal arc centered on the axis of the aft mast portion. To achieve this guidance, a circular horizontal bracket 40 is fastened at the level of the main boom to the aft side of mast portion 38; this bracket portion 10 at the level of mounting block 38 carries the sliding shoe 42 which pivots about the longitudinal axis of the main boom 44 at the forward end of the main boom. This rotatable connection makes it possible to reef the sail in the conventional way so that main boom 44 is rotated about its axis, thus winding the sail on it while the halyard is slackened accordingly.

Alternatively, main boom 44 may at its forward end have a tongue 46 extending longitudinally which enters into a horizontal slot formed in block 38 and is rotatable about a vertical pivot pin 48 in the block 38. This arrangement prevents the lower luff of the sail from becoming undesirably stretched when the aft mast portion 12 is rotated. For the axis of rotation of the boom 44 determined by the pivot pin 48 is closely adjacent to the axis of rotation of mast portion 12.

Figure 7:
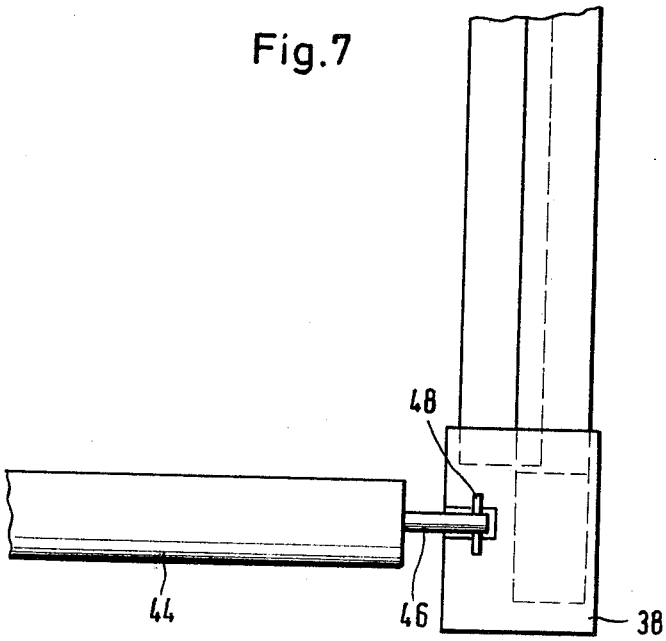
FIG. 7 shows another embodiment of the attachment of the main boom to the mast as shown in the lower portion of FIG. 4.

Neither with the embodiment of FIG. 6 nor with that of FIG. 7 is the point of attachment of main boom 44 to the mast restricted to the midships position, because this would result in undesirable stretching of the lower luff of the sail when the aft mast portion is turned.

Figure 8:
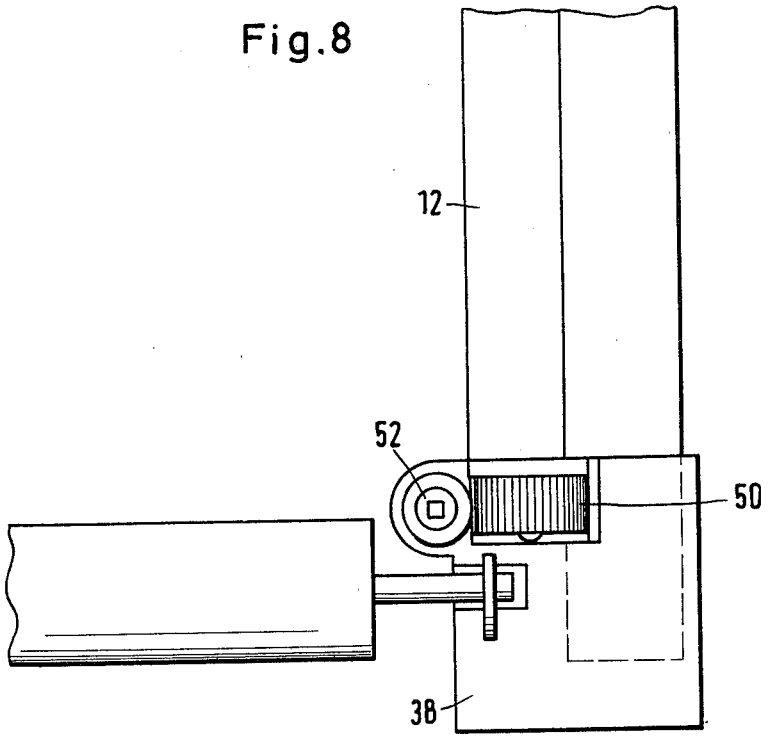
FIG. 8 shows another embodiment with a gear mechanism for turning the aft portion of the mast about its axis, as shown in FIG. 7.

FIG. 8 shows a manually-operable gear mechanism for turning mast portion 12 about its axis. For this purpose a worm gear 50 is attached to the bottom of mast portion 12 inside block 38, and a horizontal worm 52 meshes with this gear and rotates in block 38. The worm can be turned by a hand wheel to ensure that before or after each tack the place where the sail is attached to the mast can be adjusted in leeward direction.

Figure 9:
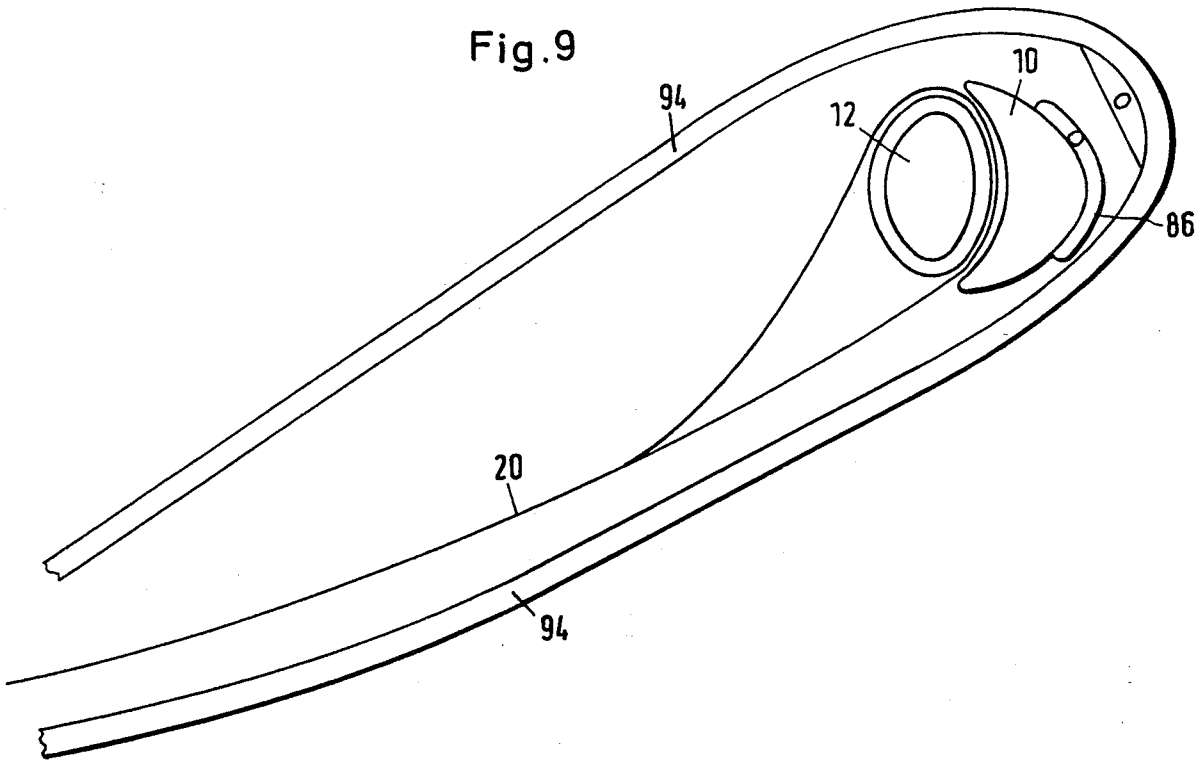
FIG. 9 shows the arrangement of a fork boom to the mast described in FIG. 1.

FIG. 9 shows a top view of the arrangement by which a wishbone boom is connected to the mast described in FIG. 1. Symmetrically to the longitudinal median plane 14 the fore mast portion 10 carries a horizontal bracket member 86 to which a sheave 88 is attached. The sheave is connected by means of a pulling element 90 with a block 92 which is flexibly attached to the inner side of the forward portion of wishbone boom 94. It is known that the sail exerts a forwardly directed tension force on the wishbone boom, thereby keeping pulling element 90 taut.

The boat "hull" as referred to herein means the complete boat body structure, exclusive of mast, sails and rigging, and includes, for example, the deck and, if there is one, the cabin structure.

I claim:

1. A sailboat mast comprising of two mast parts extending upwards from the boat hull with their longitudinal axes in the longitudinal vertical midplane of the hull, the aft one (12) of said mast parts being shaped and equipped for carrying a sail and being supported at its upper end on the forward mast part (10), said forward mast part (20) having a concave channel (32) along its aft side and being rigged to the hull (16) by means of shrouds and stays, said aft mast part (12) being free of standing rigging, both said mast parts having lower ends seated on the hull in suitable fittings, said sail (20) being fastenable to said aft mast part in a manner providing for said sail to set so that when working in a wind having a substantial athwartship component of direction, it always extends from the mast in a direction substantially tangential to the composite mast, and further comprising means (28), located at or near the mast top, for guiding and guidably supporting at least the upper portion of said aft mast part and connecting it to the upper portion of said forward mast part and also permitting said aft mast part to be bent away from said forward mast part for affecting the shape of the sail.

2. Sailboat mast as defined in claim 1, in which at least over most of its length below said guiding and connecting means (28), the aft mast part (12) is enveloped by a pocket or sleeve (22) formed from said sail (20) when said sail is set.

3. Saiboat mast as defined in claim 1, in which said sail (20), when set, is attached to said aft mast part (12) by its luff and in which said aft mast part is mounted so as to be rotatable about an axis parallel to its length dimension.

4. Sailboat mast as defined in claim 1, in which the forward surface of said forward mast part (10) is of an elliptical profile for which the major ellipse axis lies in the longitudinal vertical midplane (14) of the hull.

5. Sailboat mast as defined in claim 1 or claim 4, in which said aft mast part is of circular cross-section.

6. Sailboat mast as defined in claim 1, 2, 3, 4 or 5, in which said guiding and connecting means (28) is in the form of a cap fitting firmly on the top of the forward mast part (10) and having an aft extension containing a slot (30) running astern and centered on a line passing through the axis of the forward mast part, and in which the top of said aft mast part (12) is shaped to provide a pin (36) fitting said slot (36) for being guided therein.

* * * * *